US011351082B2

(12) United States Patent
Kim et al.

(10) Patent No.: US 11,351,082 B2
(45) Date of Patent: Jun. 7, 2022

(54) SEATING-TYPE GAIT REHABILITATION ROBOT IMPROVED IN ENTRY CHARACTERISTICS

(71) Applicant: CUREXO, INC., Seoul (KR)

(72) Inventors: Young Hwan Kim, Osan-si (KR); Hyung Jun Choi, Gwangmyeong-si (KR)

(73) Assignee: CUREXO, INC., Seoul (KR)

( * ) Notice: Subject to any disclaimer, the term of this patent is extended or adjusted under 35 U.S.C. 154(b) by 0 days.

(21) Appl. No.: 17/429,075

(22) PCT Filed: Feb. 11, 2020

(86) PCT No.: PCT/KR2020/001875
§ 371 (c)(1),
(2) Date: Aug. 6, 2021

(87) PCT Pub. No.: WO2020/166924
PCT Pub. Date: Aug. 20, 2020

(65) Prior Publication Data

US 2022/0040024 A1 Feb. 10, 2022

(30) Foreign Application Priority Data

Feb. 11, 2019 (KR) ..... 10-2019-0015451

(51) Int. Cl.
*A61H 1/00* (2006.01)
*A61H 1/02* (2006.01)

(52) U.S. Cl.
CPC ..... *A61H 1/0262* (2013.01); *A61H 1/005* (2013.01); *A61H 1/0259* (2013.01);
(Continued)

(58) Field of Classification Search
CPC ..... A61H 3/008; A61H 3/00; A61H 1/0266; A61H 1/02; A61H 1/0262;
(Continued)

(56) References Cited

U.S. PATENT DOCUMENTS 2,696,206 A * 12/1954 Bierman ..... A61H 1/0262 601/35
3,824,994 A * 7/1974 Soderberg, Sr. ..... A61H 1/0259 601/29

(Continued)

FOREIGN PATENT DOCUMENTS

JP 2012-213616 A 11/2012
JP 2016-158968 A 9/2016

(Continued)

OTHER PUBLICATIONS

English translation for WO 2016/186270, translated using espacenet.com, translated on Dec. 23, 2021.*

*Primary Examiner* — Tu A Vo
(74) *Attorney, Agent, or Firm* — Novick, Kim & Lee, PLLC; Jae Youn Kim; Jihun Kim

(57) ABSTRACT

Proposed is a seating-type gait rehabilitation robot improved in entry characteristics, and more particularly to a seating-type gait rehabilitation robot improved in entry characteristics, of which a structure is concise and simple, and in which a footrest on which a trainee can put his/her foot has the minimum height to allow the trainee to easily enter and readily use the robot without any separate entry means for entry of the trainee and is placed at an entry side for the trainee to raise a gait training effect and reduce a collision risk.

6 Claims, 9 Drawing Sheets

(52) U.S. Cl.
CPC ..... *A61H 2201/1215* (2013.01); *A61H 2201/1463* (2013.01); *A61H 2201/1633* (2013.01); *A61H 2201/1642* (2013.01); *A61H 2201/1659* (2013.01); *A61H 2201/5061* (2013.01); *A61H 2201/5071* (2013.01)

(58) Field of Classification Search
CPC .... A61H 2203/0406; A61H 2203/0431; A61H 2201/1652; A61H 2201/1642; A61H 2201/1659; A61H 2230/80; A61H 1/005; A61H 1/0259; A61H 2201/1215; A61H 2201/1463; A61H 2201/1633
See application file for complete search history.

(56) References Cited

U.S. PATENT DOCUMENTS 5,474,520 A * 12/1995 Bittikofer ..... A61H 1/0266 601/27
7,887,464 B1 * 2/2011 Jones ..... A61H 1/0262 601/35
9,277,883 B2 * 3/2016 Hsieh ..... A61B 5/486
2008/0234113 A1 * 9/2008 Einav ..... A61H 1/0266 482/66
2009/0298653 A1 * 12/2009 Rodetsky ..... A61H 1/0262 482/69
2010/0268129 A1 * 10/2010 Park ..... A61H 3/008 601/35
2010/0285929 A1 * 11/2010 Bayerlein ..... A63B 21/00181 482/54
2012/0004581 A1 * 1/2012 Dinon ..... A61H 1/0237 601/23
2012/0253242 A1 * 10/2012 Lee ..... A61H 1/0262 601/35
2014/0087922 A1 * 3/2014 Bayerlein ..... A63B 21/00181 482/54
2014/0100491 A1 * 4/2014 Hu ..... A63B 23/03541 601/27
2014/0371640 A1 * 12/2014 Schorgendorfer ... A61H 1/0262 601/35
2016/0213972 A1 * 7/2016 Waldner ..... A61H 1/0262
2016/0338896 A1 * 11/2016 Gruben ..... A61H 1/0262
2017/0007489 A1 * 1/2017 Lin ..... A61H 1/0262
2018/0071580 A1 * 3/2018 Lee ..... A61H 3/00
2018/0104542 A1 * 4/2018 Kwon ..... A63B 21/0058
2018/0161220 A1 * 6/2018 Hong ..... A61G 7/1046
2018/0168908 A1 * 6/2018 Han ..... A61H 1/02
2019/0336379 A1 * 11/2019 Lin ..... A61H 1/0266
2020/0078251 A1 * 3/2020 Benda ..... A61H 1/0229

FOREIGN PATENT DOCUMENTS

KR 20130096878 A 9/2013
KR 20150078399 A 7/2015
KR 10-1623686 B1 5/2016
KR 10-2016-0063491 A 6/2016
KR 10-2019-0066221 A 6/2019
WO WO-2010136160 A1 * 12/2010 ..... A61H 1/005
WO WO-2016186270 A1 * 11/2016 ..... A61H 3/008
WO WO-2018192861 A1 * 10/2018 ..... A61H 1/02

* cited by examiner

SEATING-TYPE GAIT REHABILITATION ROBOT IMPROVED IN ENTRY CHARACTERISTICS

TECHNICAL FIELD

The disclosure relates to a seating-type gait rehabilitation robot improved in entry characteristics, and more particularly to a seating-type gait rehabilitation robot improved in entry characteristics, of which a structure is concise and simple, and in which a footrest on which a trainee can put his/her foot has the minimum height to allow the trainee to easily enter and readily use the robot without any separate entry means for entry of the trainee and is placed at an entry side for the trainee to raise a gait training effect and reduce a collision risk.

BACKGROUND ART

In general, a gait rehabilitation robot refers to a treatment robot for the rehabilitation treatment or the like, and has been used for spinal cord injury include paraplegia, cerebral stroke, traumatic brain injury, amyotrophy, parkinsonism, multiple sclerosis, cerebral palsy, training for standing sense improvement, etc.

Such a gait rehabilitation robot is generally based on a method of using an overhead harness-type load traction device to support the weight of a trainee, in which an overhead harness has advantages of pulling a load in a completely upward direction, and relatively freely tying a subject to be pulled in other directions than the direction of gravity due to the flexibility of the harness.

However, there are disadvantages that it takes too much time when a patient puts on the overhead harness, it is inconvenient to use the overhead harness because the patient cannot wear the overhead harness by him/herself without help of one or two separate medical personnel, and it is impossible to use the overhead harness for a long time because pain is caused by a load focused on a body part that is unsuitable for long-time support of the load during wear. In particular, the overhead harness-type gait rehabilitation robot has limitations that it is not installable in a low-ceilinged structure because its overall height in an upper direction of the harness is so high that a patient can be suspended.

As a method of solving such problems, there has been proposed Korean Patent No. 10-1623686 filed by the same applicant and titled 'A SEATING-TYPE ROBOT FOR GAIT TRAINER APPARATUS.'

The seating-type gait rehabilitation robot 10 includes a weight supporting part 1, a walk actuating part 2, and a trainee transfer part 3 as shown in FIGS. 1A and 1B.

The weight supporting part 1 includes an elevating part 11 installed inside a vertical support 50 and connected to an elevating frame, a connection frame 6 connected to the elevating frame, and a seating part 12 including a saddle 7 or the like installed in the connection frame 6.

The walk actuating part 2 includes a pair of weight supporting links 223 installed in parallel having a predetermined length at rear opposite sides of the weight supporting part 1 so that a trainee can undergo gait training, and a uniaxial actuating part 21, a biaxial actuating part 22, and a triaxial actuating part 23 to actuate the weight supporting links 223 and footrests 233 according to walk tracking together with the footrests 233.

In more detail, the uniaxial actuating part 21 transfers actuation of a uniaxial motor 211 to a uniaxial actuating table 213 via a uniaxial speed reducer 212, a uniaxial actuating pulley 215, a uniaxial straight-actuating belt 214, etc., thereby making the weight supporting links 223 rectilinearly move forward and backward together with the footrest 233.

The biaxial actuating part 22 makes a front side of the weight supporting links 223 rotate to move up and down together with the footrest 233 by actuation of the biaxial motor 221 transferred via the weight supporting links 223 through a speed reducer 222.

The triaxial actuating part 23 includes a triaxial motor 231 installed in an internal middle of the weight supporting links 223, an orthogonal triaxial speed reducer 232 connected to the triaxial motor 231 and having an output terminal connected to a lateral side of the footrest 233, and the footrest 233, in which the lateral side of the footrest 233 is connected to the triaxial speed reducer 232 so that the footrest 233 can relatively rotate with respect to the weight supporting link 223.

The trainee transfer part 3 includes a sloping part 31 installed in a rear end of the walk actuating part 2, a position changing part 32 installed on the walk actuating part 2, and a guide part 33 guiding movement of the position changing part 32.

Further, the walk actuating part 2 is attached with an external cover 15 to cover the walk actuating part 2 at left/right sides and a front side thereof, the weight supporting part 1 is installed standing in the front side of the walk actuating part 2, and the trainee transfer part 3 is installed at a back side of the walk actuating part 2 so as to transfer a trainee.

In the foregoing seating-type gait rehabilitation robot 10, there is no need of putting the harness on a trainee because the foot rest 233 moves along the walk tracking by the wall actuating part 2 when the trainee puts his/her foot on the footrest 233 while seating on the saddle 7 of the seating part 12, thereby solving various problems of the foregoing harness-type gait rehabilitation robot. However, the foregoing seating-type gait rehabilitation robot 10 has various shortcomings as follows.

First, in the conventional seating-type gait rehabilitation robot 10, as shown in FIG. 1B, when the actuation of the uniaxial motor 211 is transferred to the uniaxial actuating table 213 via the uniaxial speed reducer 212, the uniaxial actuating pulley 215, the uniaxial rectilinear actuating belt 214, etc., the uniaxial actuating table 213 rectilinearly moves forward and backward as guided by an LM guide unit or the like translatory guide device placed under the uniaxial actuating table 213. In this case, the LM guide unit (not shown) is supported by a floor support frame including a quadrangular rod or the like rolled steel material, and a board material or the like.

As described above, the overall height of the installation position is increased by the height of the LM guide unit (not shown) because the uniaxial actuating part 21 is provided on the top of the LM guide unit (not shown) installed on a floor for the rectilinear movement of the uniaxial actuating table 213, and therefore the overall height of the weight supporting links 223 and the footrest 233 installed in the uniaxial actuating table 213 is also increased, thereby having a disadvantage of separately requiring the trainee transfer part 3 to move the trainee close to the footrest 233 as shown in FIG. 1A.

Further, the trainee transfer part 3 is formed with the sloping part 31 for movement of a wheelchair-seated trainee as shown in FIG. 1, and is thus long in forward and backward directions, thereby increasing the length of the seating-type gait rehabilitation robot by several meters or more. Therefore, there are disadvantages that the gait rehabilitation robot is not compactly manufactured and increases an occupied area to thereby make it difficult to be installed in a medical treatment center having a limited space.

In particular, there are disadvantages that it is inconvenient for a wheelchair-seated trainee to use the conventional seating-type gait rehabilitation robot 10 because the trainee cannot move along the sloping trainee transfer part 3 by him/herself and needs a medical staff's help to undergo training, and therefore incurred labor costs increase training costs.

Further, the conventional seating-type gait rehabilitation robot 10 has disadvantages that the manufacture of the trainee transfer part 3 is additionally needed, the trainee transfer part 3 is so bulky that a lot of materials such as rolled steel or the like are consumed, and manufacturing costs are increased due to manufacturing-personnel expenses or the like.

Further, the conventional seating-type gait rehabilitation robot 10 has disadvantages that the footrest 233 on which a trainee puts his/her foot is disposed biased forward and thus highly likely to collide with a front structure during training, thereby lowering effects on gait rehabilitation training as tracking of footrest exercise is restricted due to such disposition limitations.

Further, the conventional seating-type gait rehabilitation robot 10 has disadvantages that it is difficult and hard for a patient who cannot walk with a normal gait to enter because the footrest 233 is biased forward and therefore an entry distance for entry is relatively long when it is taken into account that a trainee enters from the back.

Besides, the conventional seating-type gait rehabilitation robot 10 has disadvantages that its structure is complicated and foreign materials are easily accumulated because a seal belt 40 or the like is required to prevent aesthetic deficits and accidents due to the exposure of the motor, the speed reducer, etc. of the walk actuating part 2 as shown in FIG. 1B, thereby causing a breakdown and making it difficult to maintain cleanness.

DISCLOSURE

Technical Problem

Accordingly, the disclosure is proposed based on the foregoing content, and an aspect of the disclosure is to provide a seating-type gait rehabilitation robot improved in entry characteristics, of which a structure is concise and simple, and in which a footrest on which a trainee can put his/her foot has the minimum height to allow the trainee to easily enter and readily use the robot without any separate entry means for entry of the trainee Another aspect of the disclosure is to provide a seating-type gait rehabilitation robot improved in entry characteristics, in which a footrest is placed at an entry side for the trainee, so that a walking track can be freely designed, thereby raising a gait training effect, reducing a collision risk, and making it more convenient and easier for the trainee to enter and use.

Technical Solution

According to an aspect of the disclosure, there is provided a seating-type gait rehabilitation robot improved in entry characteristics, the seating-type gait rehabilitation robot including: a weight supporter including an elevator connected to a vertical supporter and moving up and down, and a seat connected to the elevator; and a walk actuator including a pair of footrests on which a trainee puts left and right foots to undergo gait training, a footrest supporter to which the footrest is connected, and a footrest actuator configured to actuate the footrest and the footrest supporter, wherein the footrest actuator comprises a translatory actuator, the translatory actuator comprising a transfer mechanism to which the footrest supporter is connected so that the footrest actuator can make translatory movement of the footrest supporter, and a transfer actuator configured to apply an actuating force to the transfer mechanism, and the seating-type gait rehabilitation robot further includes an actuator hanging member configured to hang and support the transfer mechanism.

The transfer mechanism may include a guide rail installed as hung in a translatory direction, a slider connected to the guide rail, and a transfer base on which the slider and the footrest supporter are installed, and the actuator hanging member may include a lateral wall to which the guide rail is coupled.

Further, the guide rail may include a plurality of guide rails coupled to an inner side of the lateral wall as spaced apart up and down from each other, and the transfer base may include a vertical base to which the slider is coupled, and a horizontal base disposed perpendicularly to a lower portion of the vertical base.

Preferably, the transfer actuator may include: a transfer belt including opposite ends fastened to the transfer base, and installed to be movable along a disposition path of the guide rail; a transfer motor configured to generate and provide an actuating force for movement of the transfer belt; a transferer speed reducer connected to a motor shaft of the transfer motor and performing a speed-reducing function; a transferer driving pulley installed in an output terminal of the transferer speed reducer and engaging with a first side of the transfer belt; and a transferer driven pulley disposed spaced apart from the transferer driving pulley and engaging with a second side of the transfer belt.

Meanwhile, the footrest supporter may include a first end connected to the transfer mechanism and a second end to be mounted with the footrest, and a coupling portion between the footrest supporter and the transfer mechanism is placed inside the entry space so that the footrest can be disposed toward an entrance of an entry space formed between the left and right actuator hanging members.

Further, the footrest actuator may include a supporter rotation actuator configured to perform rotating movement of the footrest supporter, a footrest rotation actuator configured to perform rotational movement of the footrest, and a translatory actuator including a transfer mechanism to which the footrest support is connected and a transfer actuator configured to apply an actuating force to the transfer mechanism, the transfer mechanism may include a guide rail installed as hung in a translatory direction, a slider connected to the guide rail, and a transfer base on which the slider and the footrest supporter are installed, and the transfer base may include a vertical base to which the slider is coupled, and a horizontal base disposed perpendicularly to a lower portion of the vertical base, in which the footrest supporter is rotatably coupled to the supporter rotation actuator installed on the horizontal base.

Meanwhile, the supporter rotation actuator may include a supporter rotation motor, and a supporter speed reducer configured to reduce rotational speed of the supporter rotation motor, and the footrest supporter may include a supporting link connected to an output terminal of the supporter speed reducer, and the horizontal base is formed with a rotation hole in which a connector of the supporting link is rotatable as accommodated.

Further, the seating-type gait rehabilitation robot improved in entry characteristics may further include: a main base member in which the actuator hanging member is installed; and a cover member installed outside the actuator hanging member.

Advantageous Effects

As described above, In the seating-type gait rehabilitation robot improved in entry characteristics according to the disclosure, the walk actuator is installed as hung onto the actuator hanging member placed at the lateral side, and therefore the entry space for allowing a wheelchair or a trainee to enter is secured between both the actuator hanging members, so that the trainee can easily enter the robot while sitting on the wheelchair even though the conventional entry means for the entry of the trainee is not additionally provided or installed, thereby having an effect on use convenience and making it easier for the trainee to get on the gait rehabilitation robot because the footrest on which a trainee puts his/her foot can have the minimum height.

In particular, in the seating-type gait rehabilitation robot improved in entry characteristics according to the disclosure, the walk actuator is installed as hung onto the actuator hanging member placed at the lateral side, it is possible to dispose the footrest of the walk actuator at the height similar to the footrest height of the wheelchair, and the footrest supporter is connected to the transfer mechanism of the translatory actuator placed in a deep inner position of the entry space so that the position of the footrest of the walk actuator and the position of the footrest of the entering wheelchair can get closer to each other, thereby having advantages that help of medical personnel is minimized during entry and a patient who has a low degree of disability can sit and undergo training without the help of the medical personnel.

Further, in the seating-type gait rehabilitation robot improved in entry characteristics according to the disclosure, the footrest is positioned at an entry side for a trainee, i.e. an outside and therefore an enough distance for the movement of the walk actuator is secured in an inward direction. Therefore, accidents are prevented because risks of collision with a front structure during training are reduced, and gait-rehabilitation training effects are enhanced because a tracking range of footrest movement is sufficiently secured.

Further, in the seating-type gait rehabilitation robot improved in entry characteristics according to the disclosure, the trainee transferer needed for a trainee to enter the conventional seating-type gait rehabilitation robot is not necessary, thereby having advantages that the help of medical personnel or the like is minimized and training costs are reduced by improvement in use convenience. Further, the seating-type gait rehabilitation robot has a concise and simple structure and is decreased overall volume and weight, thereby having advantages of remarkably reducing manufacturing costs, installation costs, and maintenance costs.

Besides, the walk actuator according to the disclosure is installed as hung onto the actuator hanging member placed at the lateral side, and therefore it is possible to remove a seal belt and the like complicated devices required to cover the conventional walk actuating part, thereby making a more concise and simpler structure, reducing causes of a breakdown, and easily carrying out maintenance.

MODE FOR INVENTION

Below, embodiments of the disclosure will be described in detail with reference to the accompanying drawings of FIGS. 2 to 6B, in which like numerals refer to like elements throughout FIGS. 2 to 6B. Meanwhile, illustrations and detailed descriptions about the elements and their operations and effects, which will be easily understood based on general technology by a person having an ordinary skill in the art, in the accompanying drawings will be simplified or omitted, while illustrating only parts relevant to the disclosure.

Figure 1A:
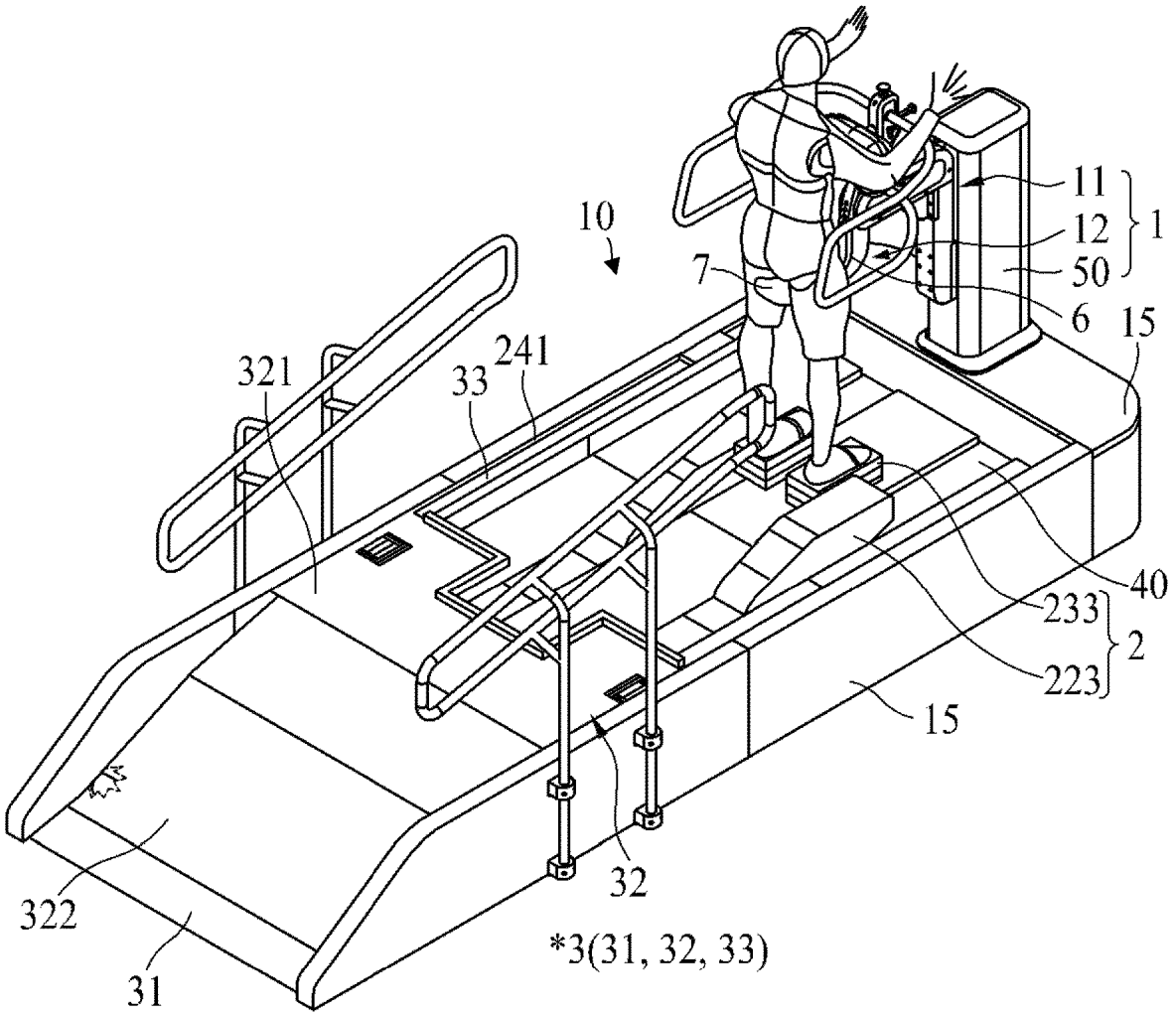
FIG. 1A PRIOR ART
FIG. 1A is a perspective view illustrating an overall structure of a conventional seating-type gait rehabilitation robot.
Figure 1B:
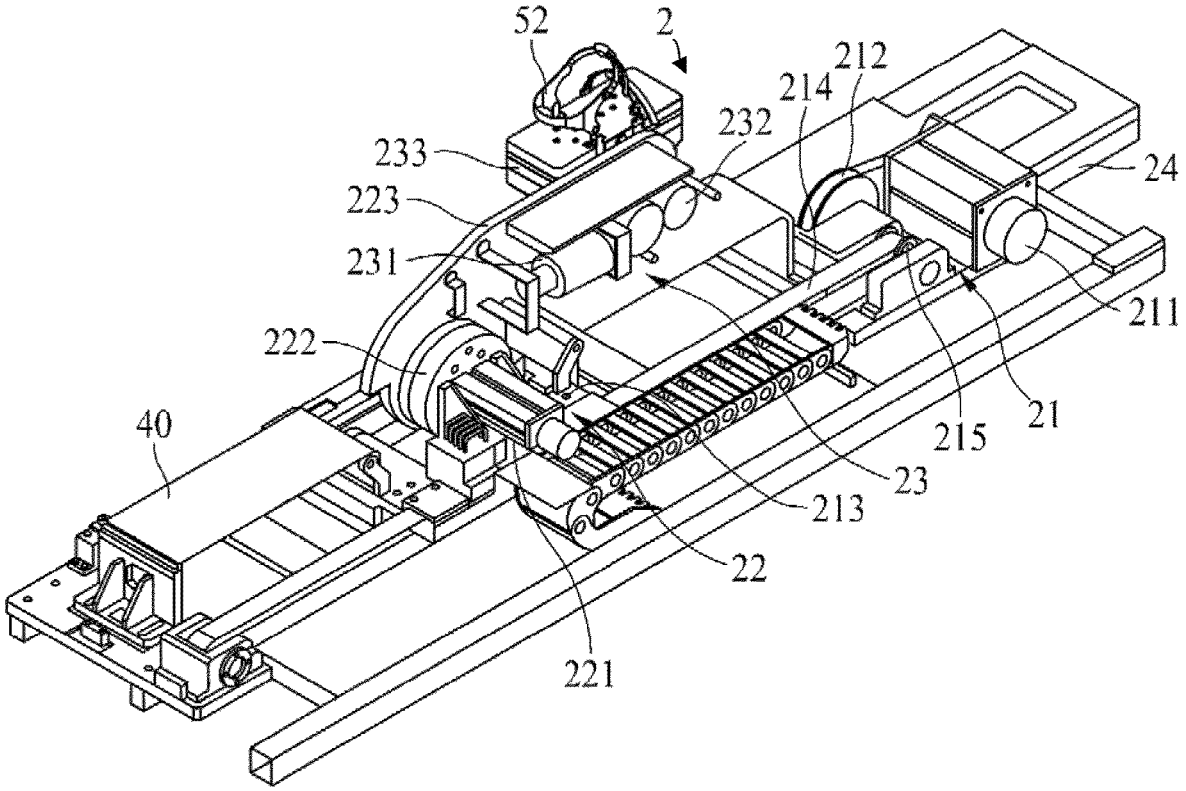
FIG. 1B PRIOR ART
FIG. 1B is a partially enlarged perspective view illustrating internal parts of a walk actuator by removing an upper component from the conventional seating-type gait rehabilitation robot.
Figure 2:
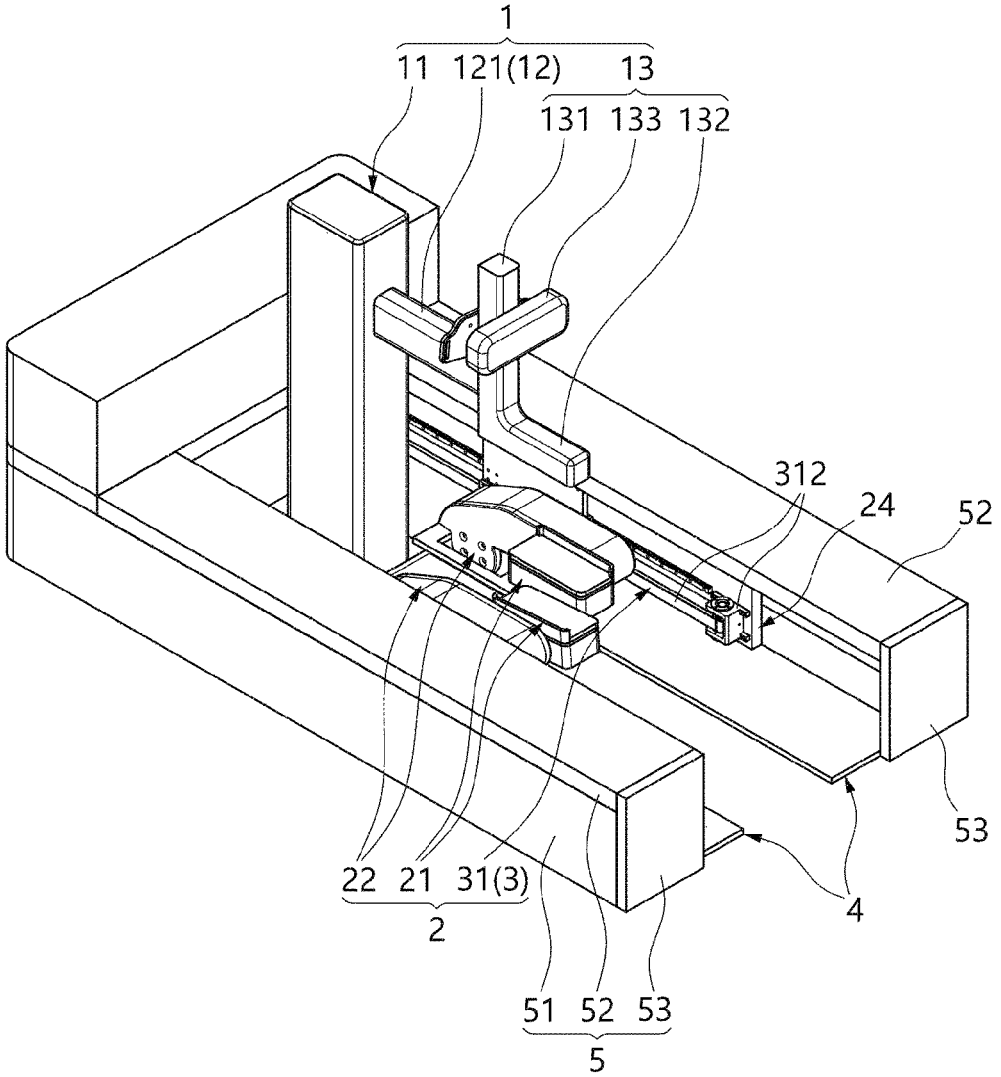
FIG. 2 is a perspective view for illustrating a seating-type gait rehabilitation robot improved in entry characteristics according to a first embodiment of the disclosure.
Figure 3:
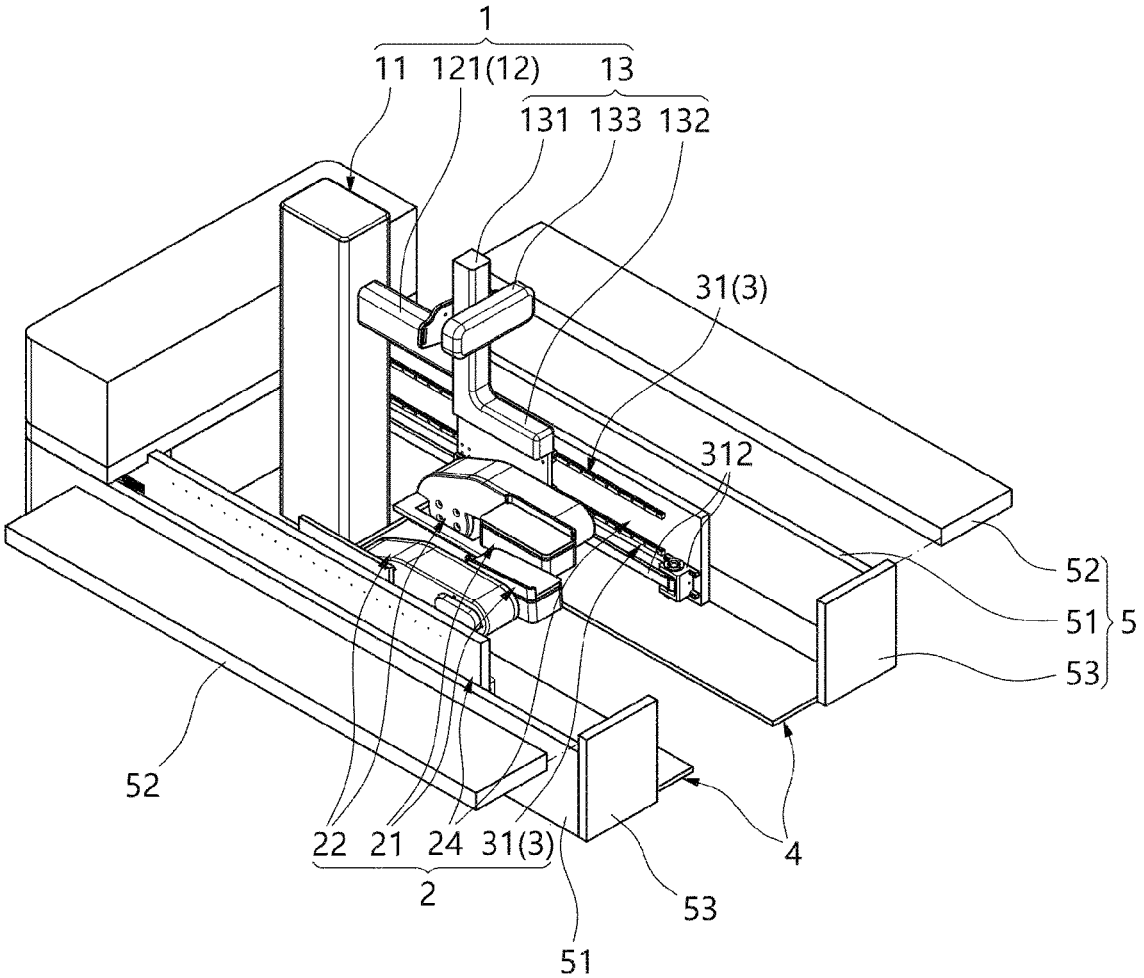
FIG. 3 is a perspective view for illustrating the seating-type gait rehabilitation robot improved in entry characteristics according to the first embodiment of the disclosure, from which some components are separated.

FIG. 2 is a perspective view for illustrating a seating-type gait rehabilitation robot improved in entry characteristics according to a first embodiment of the disclosure, and FIG. 3 is a perspective view for illustrating the seating-type gait rehabilitation robot improved in entry characteristics according to the first embodiment of the disclosure, from which some components are separated.

Referring to FIGS. 2 and 3, the seating-type gait rehabilitation robot improved in entry characteristics according to the first embodiment of the disclosure includes a weight supporter 1 supporting the weight of a trainee such as a patient, etc. who needs gait-rehabilitation training; and walk actuators 2 symmetrically placed at opposite sides with respect to the weight supporter 1 so that a trainee getting on the weight supporter 1 can substantially undergo gait-rehabilitation training, in which a footrest 21 of the walk actuator 2 on which the trainee puts his/her foot has the minimum height from a floor, thereby allowing the trainee to easily enter without any separate entry means for entry of the trainee.

To this end, in the seating-type gait rehabilitation robot improved in entry characteristics according to the first embodiment of the disclosure, a translatory actuator 31 of the walk actuator 2 is not installed in a lower portion but installed hung on a lateral portion so as to lower a home-position height of the footrest 21. Hereinafter, detailed description will be made focusing on the walk actuator 2, which is distinctive as compared with that of a conventional seating-type gait rehabilitation robot, while simplifying or omitting descriptions about the weight supporter 1, a controller (not shown) for controlling actuation of the weight supporter 1 and the walk actuator 2, a display (not shown) for displaying an actuating state, and the like elements.

Figure 4A:
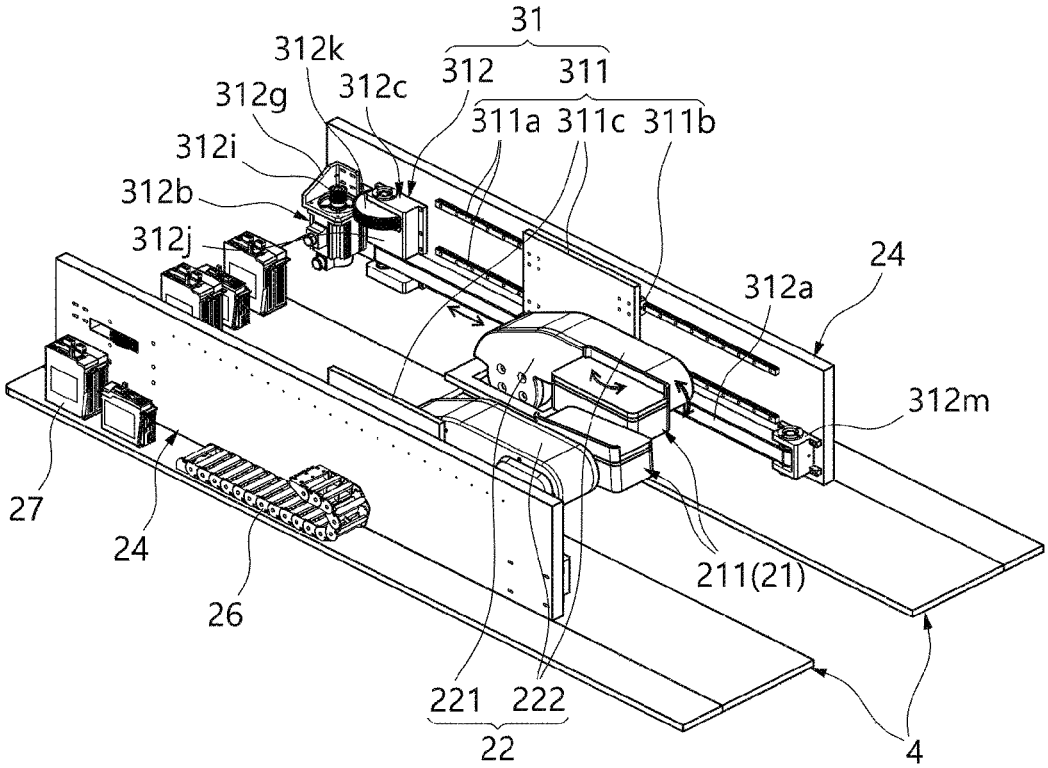
FIGS. 4A and 4B are perspective views for illustrating major parts of the seating-type gait rehabilitation robot improved in entry characteristics according to the first embodiment of the disclosure.
Figure 4B:
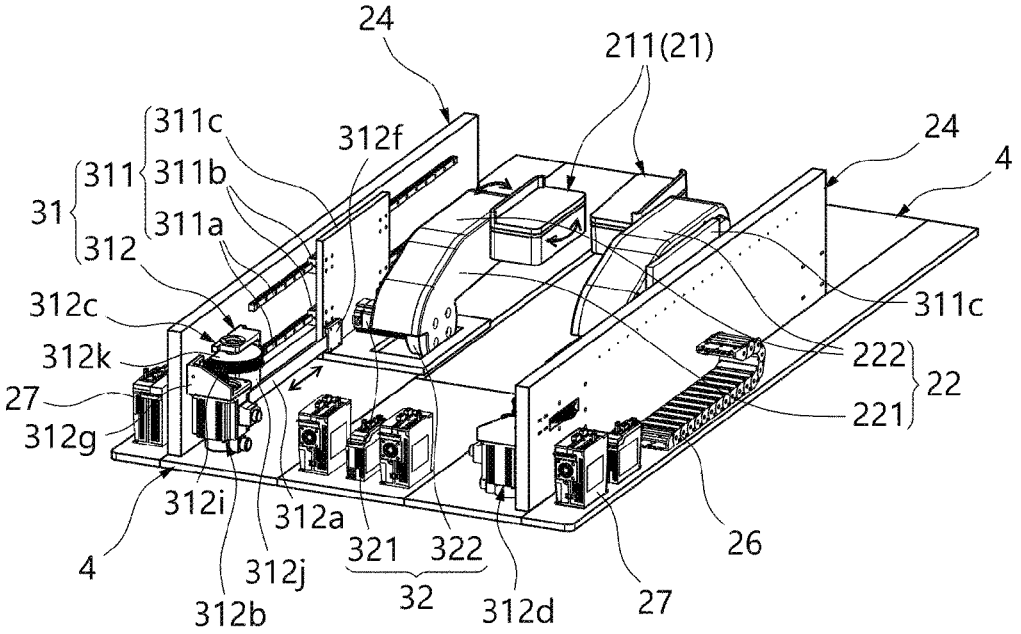
Figure 5:
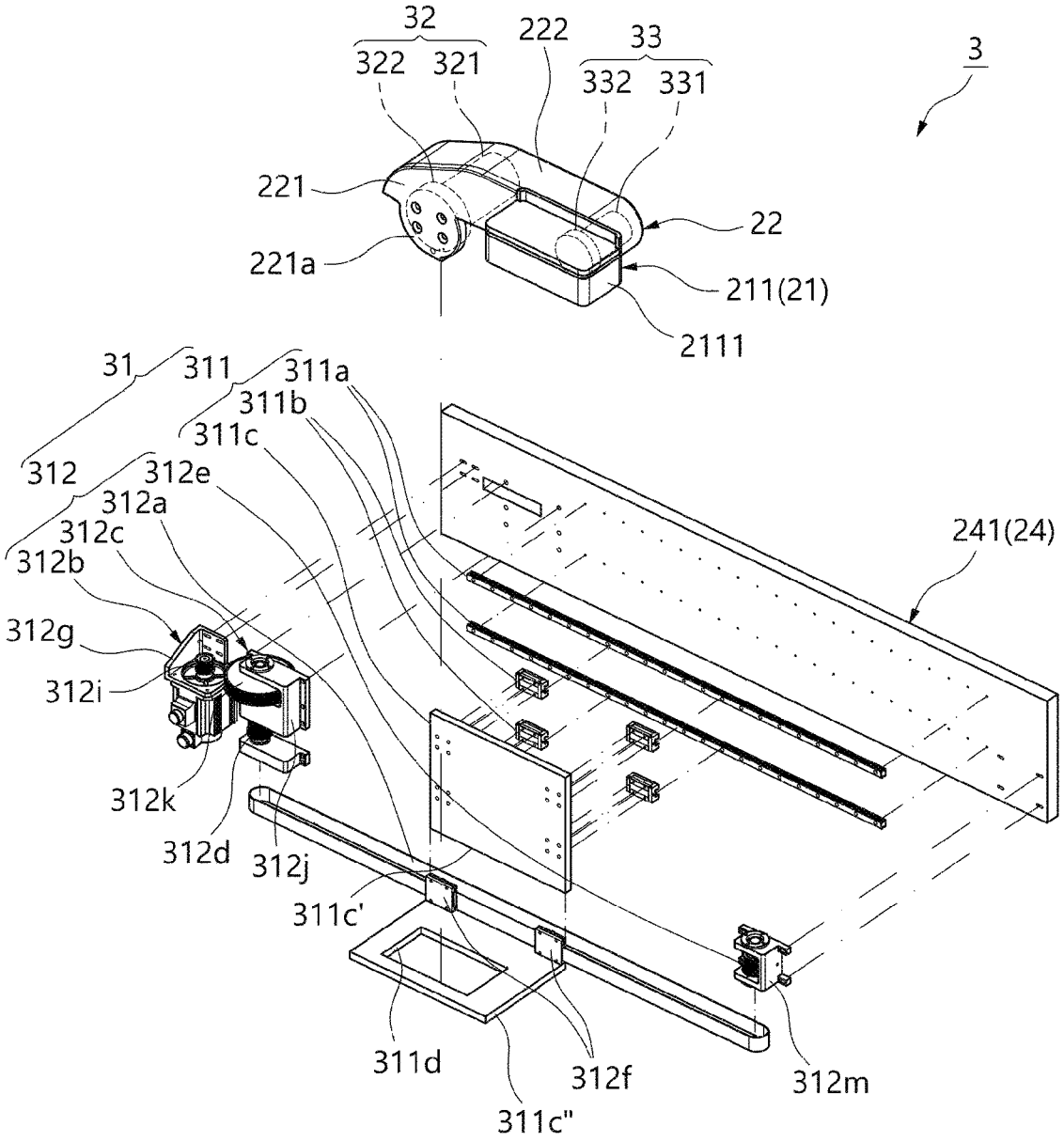
FIG. 5 is an exploded perspective view for illustrating the major parts of the seating-type gait rehabilitation robot improved in entry characteristics according to the first embodiment of the disclosure.

FIGS. 4A and 4B are perspective views for illustrating major parts of the seating-type gait rehabilitation robot improved in entry characteristics according to the first embodiment of the disclosure, in which FIG. 4A shows the parts as viewed from the front (in an entry direction of a trainee), and FIG. 4B shows the parts as viewed from the back (in an opposite direction to the entry direction of the trainee. FIG. 5 is an exploded perspective view for illustrating the major parts of the seating-type gait rehabilitation robot improved in entry characteristics according to the first embodiment of the disclosure.

Referring to FIGS. 4A to 5, the weight supporter 1 includes a vertical supporter 11 functioning as a pillar; an elevator 12 including an elevating frame 121 connected to the vertical supporter 11, an elevation device (not shown) placed inside the vertical supporter 11 and connected to the elevating frame 121, etc.; and a seat 13 including a connection frame 131 connected to the elevating frame 121, a saddle 132 installed in the connection frame 131, etc.

Further, the seat 13 is installed with a chest supporter 133 to support a chest of a trainee, and a handle (not shown) to be gripped by a trainee.

The elevation device (not shown) may be variously configured without limitations as long as it can move the elevator 12 up and down while a trainee is sitting on the seat 13. However, the elevation device in this embodiment may be configured to include a guide rail (not shown) longitudinally installed inside the vertical supporter, an LM guide module (not shown) with a slider (not shown) moving on the guide rail, a servo motor (not shown) for generating and applying actuating force to move the slider (not shown), and a ball screw (not shown) for moving the slider up and down while rotating as connected to the servo motor, like those shown in the mechanism of the background art.

Meanwhile, the walk actuator 2 includes one pair of footrests 21 on which a trainee puts his/her left and right feet to undergo gait training, one pair of footrest supporters 22 to which the footrests 21 are connected, and a footrest actuator 3 for actuating the footrest supporter 22.

The footrest 21 allows a trainee to put his/her foot thereon to thereby smoothly under to gait-rehabilitation training. The footrest 21 may be variously configured without limitations of its shape or structure as long as it is easy to separate a trainee's foot from the footrest 21 when the trainee goes into spasm or the gait rehabilitation robot malfunctions.

For example, the footrest 21 is installed with a footrest body 211 in which a plurality of footrest members 2111 shaped like an approximately rectangular plate are detachably provided; a foot locker (not shown) provided as a locking band or an auxiliary shoe to lock a trainee's foot to the footrest body 211; a footrest member binder (not shown) such as an electromagnet installed inside the footrest body so that the plurality of footrest members 2111 are bound together and separated from each other; a foot sensor (not shown) configured to sense the conditions of the trainee such as a patient's spasm or the like by detecting the pressure or force applied to the footrest body 211; etc.

Here, the foot sensor may employ load cells representatively described in the background art, but may be selected among various pressure sensors such as a capacitive pressure sensor, a strain gauge pressure sensor, a potentiometric pressure sensor, a piezoelectric pressure sensor, a silicon pressure sensor, etc.

When a force stronger than a predetermined level is applied to the footrest due to a patient's spasm, the malfunction of the gait rehabilitation robot or the like emergency, the foot sensor makes the foot locker release a binding force of the footrest member binder (i.e., a magnetic force of an electromagnet applied to the footrest member), which binds the footrest member 2111 under control of the controller, thereby preventing accidents.

Meanwhile, the footrest supporter 22 is shaped like an arm having a first end is connected to a transfer mechanism 311 (to be described later), and a second end to which the footrest 21 is mounted, and includes a supporting link 221 connected to an output terminal of a supporter speed reducer 322 (to be described later), and a supporter housing 222 coupled to the supporting link 221.

Further, it is important that the footrest supporter 22 is coupled to make a coupling portion between the supporting link 221 of the footrest supporter 22 and the transfer mechanism 311 be close to the weight supporter 1, i.e., the inner side of the entry space so that a trainee can easily enter an entry space formed between the left and right actuator hanging members 24.

Figure 6A:
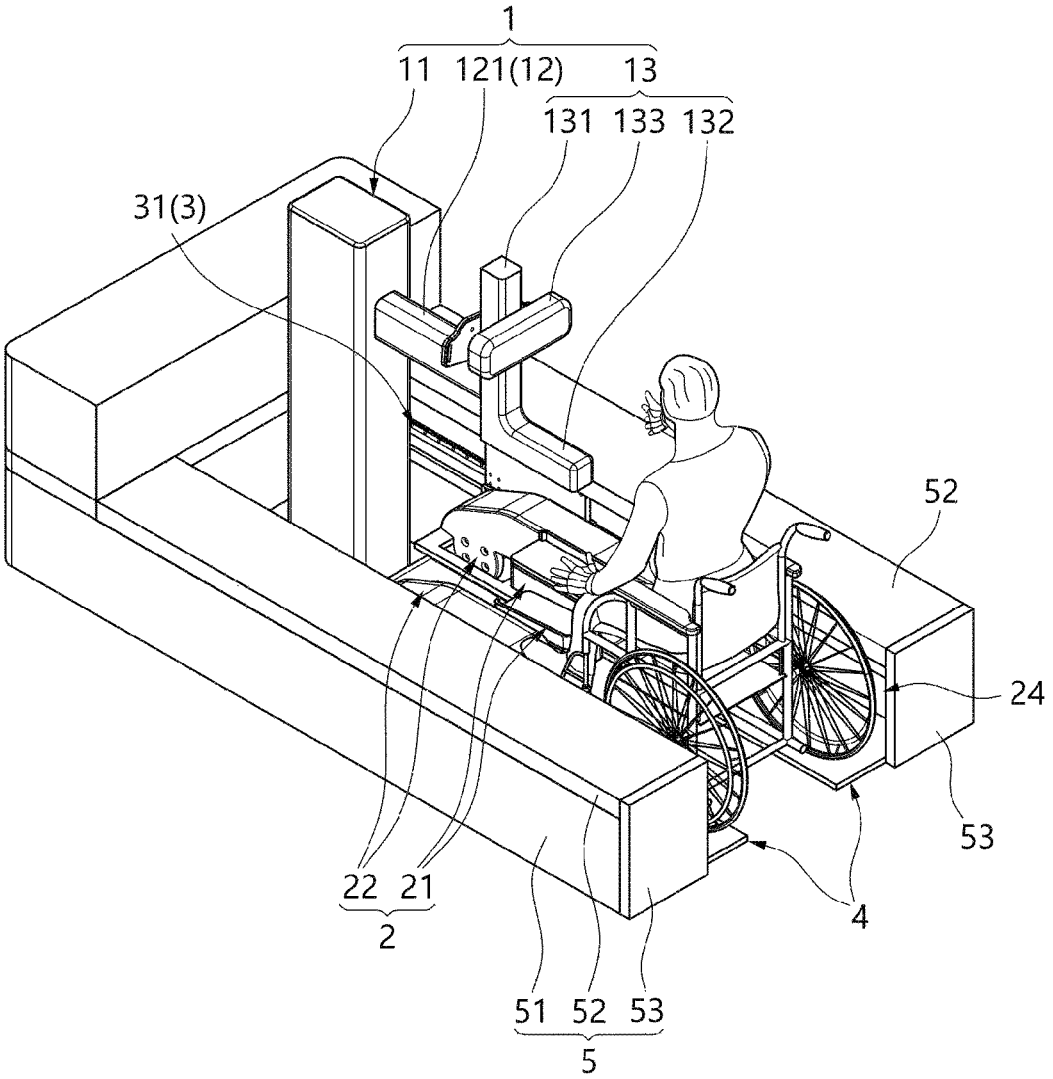
FIGS. 6A and 6B are perspective views for describing use states of the seating-type gait rehabilitation robot improved in entry characteristics according to the first embodiment of the disclosure.

Like this, when a connector 221*a* of the supporting link 221 of the footrest supporter 22 is coupled to the inner side of the entry space, the footrest 21 is naturally disposed toward the entrance of the entry space formed between the left and right actuator hanging members 24 and is thus convenient for a trainee in a wheelchair to position his/her foot in the proximity of the footrest 21 as shown in FIG. 6A.

Meanwhile, the footrest actuator 3 includes a translatory actuator 31 for actuating the footrest supporter 22 to move frontward and backward in a translational direction, a supporter rotation actuator 32 for actuating the footrest supporter 22 to rotate, and a footrest rotation actuator 33 for actuating the footrest 21 to rotate, in which an actuator hanging member 24 is provided so that the translatory actuator 31 can be not put on a structure installed on the floor but installed hung on the lateral portion.

The translatory actuator 31 refers to an actuator for actuating the footrest supporter 22 to move frontward and backward, and includes a transfer mechanism 311 to which the footrest supporter 22 is connected, and a transfer actuator 312 which applies an actuating force to the transfer mechanism 311.

Further, the transfer mechanism 311 is installed at an inner lateral side of the actuator hanging member 24 to lower the disposition height of the footrest supporter 22 so that the footrest 21 can have the minimum home-position height.

In more detail, the transfer mechanism 311, as shown in FIGS. 4A to 5, includes a guide rail 311*a* installed in a hanging form along a translatory direction, a slider 311*b* connected to the guide rail 311*a*, and a transfer base 311*c* on which the slider 311*b* and the footrest supporter 22 are installed. Here, the guide rail 311*a* and the slider 311*b* may be selected and used without any specific limitations as long as they are a translatory mechanism guide means for effectively guiding translational movement. In this embodiment, the guide rail 311*a* and the slider 311*b* are configured employing a translatory mechanism typically called the LM guide module.

The guide rail 311*a* and the slider 311*b* are provided in plural to guide the movement of the transfer base 311*c* while stably supporting the load of the footrest supporter 22 including the footrest 21 supporting a trainee. The plurality of guide rails 311*a* are mounted as spaced apart up and down and hung onto the inner side of the actuator hanging member 24, and the sliders 311*b* respectively corresponding to these guide rails are mounted to the transfer base 311*c*.

The transfer base 311*c* includes a vertical base 311*c*' to which the slider 311*b* coupled to the guide rail 311*a* is mounted, and a horizontal base 311*c*" coupled to a lower portion of the vertical base 311*c*'. Further, the transfer base 311*c* refers to an 'L'-shaped movable plate where the horizontal base 311*c*" shaped like a plate is formed perpendicularly to the vertical base 311*c*' shaped like a plate. The horizontal base 311*c*" is perforated and formed with a rotation hole 311*d* in which the connector 221*a* of the supporting link 221 is rotatable as accommodated.

Further, the actuator hanging members 24 are provided at the left and right sides with respect to the weight supporter 1 disposed at the center, so that the walk actuators 2 can be installed. The actuator handing member 24 includes a lateral wall 241 shaped like a rectangular plate to which the guide rail 311*a* is coupled.

When the actuator hanging member 24 includes the lateral wall 241 shaped like a plate as described above, there may be additionally provided a main base member 4 installed on the floor so that the lateral wall 241 can be locked and stably keep a standing state, and a cover member 5 installed outside the lateral wall 241.

Here, the cover member 5 includes a lateral cover plate 51 disposed in parallel with the lateral wall 241, an upper cover plate 52 installed on the lateral cover plate 51, and a connection cover plate 53 installed between the lateral cover plate 51 and the upper cover plate 52.

Further, the cover member 5 is also installed in a front direction of the weight supporter 1, and internally provided with a power supply for supplying power the weight supporter 1, the walk actuator 2 and the like, etc.

Meanwhile, the transfer actuator 312 includes a band-shaped transfer belt 312*a* of which both ends are fastened to the vertical base 311*c*' of the transfer base 311*c* by fastening brackets 312*f* and installed to move along an arranged path of the guide rail 311*a*, a transfer motor 312*b* configured to generate and provide an actuating force for the movement of the transfer belt 312*b*, a transferer speed reducer 312*c* connected to a motor shaft of the transfer motor 312*b* and performing a speed-reducing function, a transferer driving pulley 312*d* installed in the output terminal of the transferer speed reducer 312*c* and engaging with a first side of the transfer belt 312*a*, and a transferer driven pulley 312*e* disposed spaced apart from the transferer driving pulley 312*d* and engaging with a second side of the transfer belt.

Further, the transfer motor 312*b* is mounted to the actuator hanging member 24 by a coupling bracket 312*g*, and is installed with a motor electric pulley 312*i* at the motor shaft. The transferer speed reducer 312*c* is mounted to the actuator hanging member 24 by a coupling bracket 312*j*, and is installed with a speed-reducer electric pulley 312*k* with which a second side of a belt (not shown) having a first side engaging with the motor electric pulley 312*i* is engaged, and the transferer driving pulley 312*d* at the output terminal thereof. The transferer driven pulley 312*e* is rotatably installed to a coupling bracket 312*m* mounted to the actuator hanging member 24.

Further, the transfer actuator 312 refers to an element configured to apply an actuating force for movement of the slider (not shown). Besides the belt driving method shown in FIG. 5, the transfer actuator 312 may be achieved by a servo motor (not shown) mounted to the guide rail and generating an actuating force, and a ball screw (not shown) rotating as connected to the servo motor and moving the slider forward and backward, detailed illustrations of which will be omitted in the drawings.

Meanwhile, the supporter rotation actuator 32 for the rotation of the footrest supporter 22 in the footrest actuator 3 refers to an actuator for forward and reverse angular motion to carry out a similar action as if a foot is raised or lowered during walking as shown in FIGS. 4B and 5, and includes a supporter rotation motor 321 mounted to the horizontal base 311*c*", and the supporter speed reducer 32 installed in the output terminal of the supporter rotation motor 32 and reducing a rotation force.

The supporter speed reducer 322 includes an input side installed in the output terminal of the supporter rotation motor 321, and an output side installed in the connector 221*a* of the supporting link 221 of the footrest supporter 22, thereby transferring rotary power reduced by a given deceleration ratio.

Meanwhile, the footrest rotation actuator 33 for the rotation of the footrest 21 in the footrest actuator 3 refers to an actuator for forward and reverse rotation of the footrest to carry out a similar action as if a heel portion is first on the ground and a front portion is then on the ground during walking as shown in FIG. 5, and includes a footrest rotation motor 331 installed at a free end of the supporting link 221, and a footrest speed reducer 332 installed at the output terminal of the footrest rotation motor 331 and reducing a rotation speed. Here, the footrest speed reducer 332 includes a first side connected to the output terminal of the footrest rotation motor 331, and a second side connected to the lateral side of the footrest 21.

Meanwhile, in FIGS. 4A and 4B, the reference numeral of '26' indicates a cableveyor configured to move together with various cables for supplying power to the walk actuator 2 or the like while accommodating and protecting the cables, and the reference numeral of '27' indicates a motor driver configured to drive the motors 312*b*, 321, 331 of the walk actuator 2.

Below, the operations of the seating-type gait rehabilitation robot improved in entry characteristics according to the first embodiment of the disclosure will be described in brief.

Figure 6B:
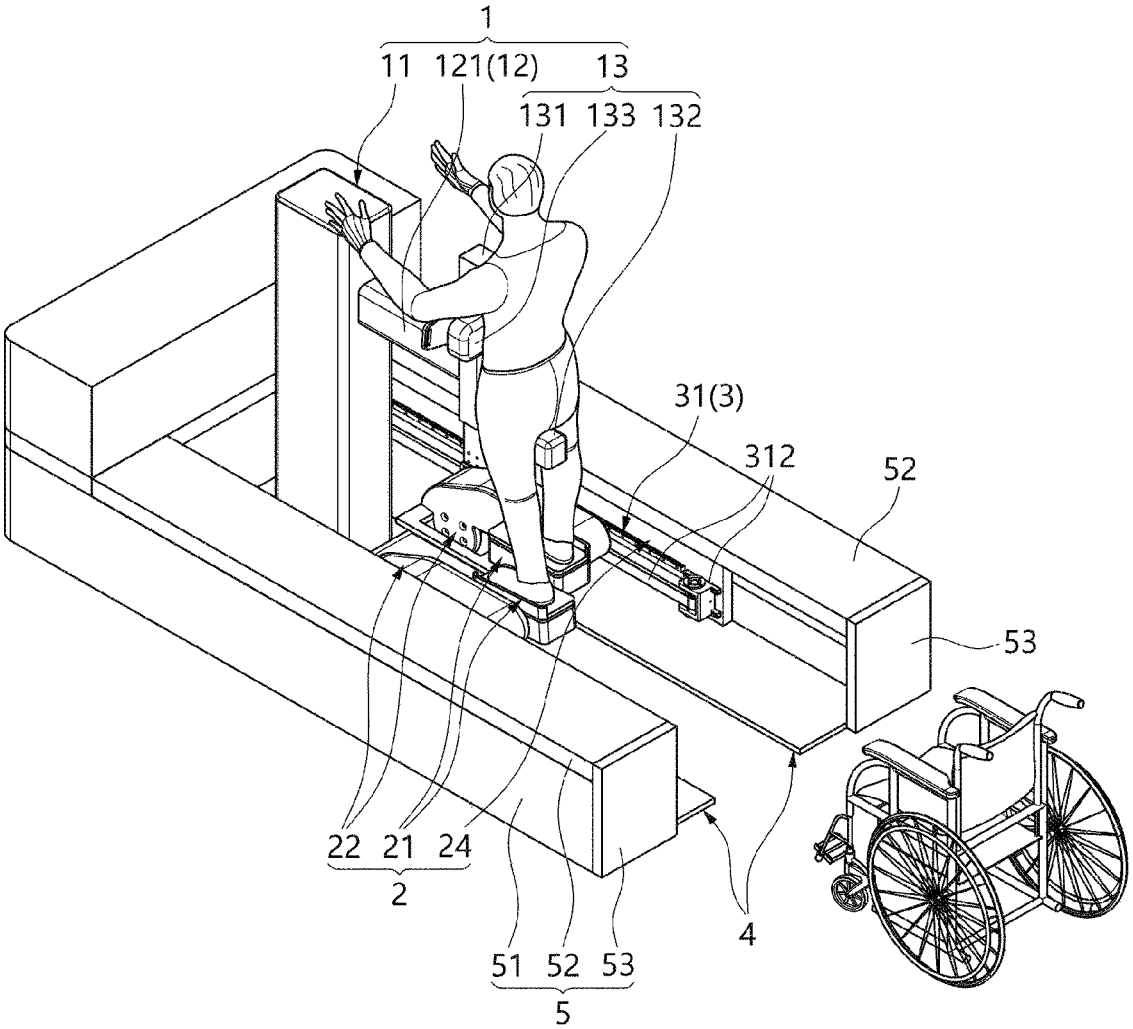

FIGS. 6A and 6B are perspective views for describing use states of the seating-type gait rehabilitation robot improved in entry characteristics according to the first embodiment of the disclosure, in which FIG. 6A shows a process that a wheelchair-seated trainee enters and FIG. 6B shows a process that the trainee undergoes training while standing on the footrest.

As shown in FIG. 6A, when a trainee who has difficulties in mobility wants to undergo gait training, the trainee moves toward the entrance of the entry space between the cover members 5 where the left and right walk actuators 2 are placed while sitting on a wheelchair, stops near the footrest 21, gets on the seat 13 so that his/her buttocks can be on the saddle 132 as shown in FIG. 6A, puts and locks his/her foot on the footrest 21 of the walk actuator 2 in the home position, and then undergoes the gait rehabilitation by the walk actuator 2 operating based on a set program.

In more detail, when a trainee gets on the seat 13 and puts his/her foot on the footrest 21 of the walk actuator 2 in position, the transfer motor 312*b* of the translatory actuator 31 operates to translate move the footrest supporter 22 frontward and backward in a translational direction, the supporter rotation motor 321 of the supporter rotation actuator 32 operates to rotate the footrest supporter 22, and the footrest rotation motor 331 of the footrest rotation actuator 33 operates to rotate the footrest 21, under control of the controller in respect to an input signal, thereby allowing the trainee to practice walking.

Meanwhile, the detailed operations of the supporter rotation actuator 32 and the footrest rotation actuator 33 are similar to those disclosed in the related art (Korean Patent No. 10-1623686 filed by the same applicant), and therefore only the translatory actuator 31, which is distinctive, will be further described.

In the translatory actuator 31, when the transfer motor 312*b* operates, the rotating force of the motor electric pulley 312*i* is transferred to the speed-reducer electric pulley 312*k* by a belt (not shown), reduced in speed by the transferer speed reducer 312*c*, output to the transferer driving pulley 312*d*, and transferred to the transfer belt 312*a* wound around the transferer driven pulley 312*e*. Thus, when the transfer belt 312*a* performs a forward and reverse orbital movement, the transfer base 311*c* fastened to the transfer belt 312*a* by the fastening bracket 312*f* moves forward and backward, so that the footrest supporter 22 including the footrest 21 coupled to the transfer base 311*c* can move forward and backward.

As described above, in the seating-type gait rehabilitation robot improved in entry characteristics according to the disclosure, the translatory actuator 31 of the walk actuator 2 is not disposed on the floor but installed as hung onto the actuator hanging member 24 placed at the lateral side, and therefore the entry space for allowing a wheelchair or a trainee to enter is secured between both the actuator hanging members 24, so that the trainee can easily enter the robot while sitting on the wheelchair even though the conventional transfer part or entry means for the entry of the trainee is not additionally provided or installed, thereby having a prominent effect on use convenience.

Further, in the seating-type gait rehabilitation robot improved in entry characteristics according to the disclosure, the translatory actuator 31 of the walk actuator 2 is installed as hung onto the actuator hanging member 24, so that the footrest 21 on which a trainee puts his/her foot can have the minimum height, thereby making it easier for the trainee to get on the gait rehabilitation robot.

In particular, it is possible to dispose the footrest 21 of the walk actuator 2 at the height similar to the footrest height of the wheelchair, and the footrest supporter 22 is connected to the transfer mechanism 311 of the translatory actuator 31 placed inside the entry space so that the position of the footrest 21 of the walk actuator 2 and the position of the footrest of the entering wheelchair can get closer to each other while facing each other, thereby having advantages that help of medical personnel is minimized and a patient who has a low degree of disability can sit and undergo training without the help of the medical personnel.

Further, in the seating-type gait rehabilitation robot improved in entry characteristics according to the disclosure, the footrest 21 is positioned at an entry side for a trainee, and therefore an enough space for the movement of the walk actuator 2 is secured, thereby having advantages of preventing accidents because there are no risks of collision with a front structure during training, and enhancing gait-rehabilitation training effects because a tracking range of footrest movement is sufficiently secured.

Besides, in the seating-type gait rehabilitation robot improved in entry characteristics according to the disclosure, the trainee transferer needed for a trainee to enter the conventional seating-type gait rehabilitation robot is not necessary, thereby having advantages that the help of medical personnel or the like is minimized and training costs are reduced by improvement in use convenience. Further, the seating-type gait rehabilitation robot has a concise and simple structure and is decreased overall volume and weight, thereby having advantages of remarkably reducing manufacturing costs, installation costs, and maintenance costs.

The foregoing description is merely one embodiment for carrying out a seating-type gait rehabilitation robot improved in entry characteristics according to the disclosure, and the disclosure is not limited to the foregoing embodiment. Thus, it will be appreciated by any person having an ordinary skill in the art that the technical idea of the disclosure falls within the extent to which various changes can be made without departing from the scope of the disclosure.

The terminology used herein is for the purpose of describing particular embodiments only and is not intended to limit the disclosure. Singular expressions include plural expressions unless the context clearly indicates otherwise. In this application, the terms "comprise" or "have" are intended to indicate that there is a feature, number, step, action, component, part, or combination thereof described in the specification, and one or more other features. It is to be understood that the disclosure does not exclude the possibility of the presence or the addition of numbers, steps, operations, components, components, or a combination thereof.

The invention claimed is:

1. A gait rehabilitation robot comprising:

a weight supporter including an elevator connected to a vertical supporter and configured for moving up and down, and a seat connected to the elevator; and a pair of walk actuators disposed at opposite sides with respect to the weight supporter with an interval therebetween for gait training of a trainee, each of the pair of walk actuators comprising a footrest, a footrest supporter to which the footrest is connected, and a footrest actuator configured to actuate the footrest and the footrest supporter, wherein the footrest actuator comprises a supporter rotation actuator configured to perform rotational movement of the footrest supporter, a footrest rotation actuator configured to perform rotational movement of the footrest, and a translatory actuator configured to perform translatory movement of the footrest supporter, the translatory actuator including a transfer mechanism to which the footrest supporter is connected and a transfer actuator configured to apply an actuating force to the transfer mechanism, wherein the rehabilitation robot further comprises a pair of actuator hanging members disposed at opposite sides with respect to the weight supporter with an interval therebetween to form lateral walls to hang and support the transfer mechanism, wherein the transfer mechanism comprises a plurality of guide rails coupled to an inner side of the respective lateral wall to be spaced apart up and down from each other and extending in a translatory direction, a slider connected to the plurality of guide rails and configured to move by the actuating force applied from the transfer actuator, and a transfer base on which the slider and the footrest supporter are disposed, wherein the transfer base comprises a vertical base to which the slider is coupled, and a horizontal base disposed perpendicularly to a lower portion of the vertical base, the footrest supporter being rotatably coupled to the supporter rotation actuator disposed on the horizontal base, and wherein the footrest supporter is connected to the transfer mechanism and the footrest is mounted on the footrest supporter, and a front end of the footrest supporter is placed inside an entry space for allowing a wheelchair or the trainee to enter so that the footrest is disposed toward an entrance of the entry space formed between the pair of actuator hanging members.

2. The gait rehabilitation robot of claim 1, wherein the transfer actuator comprises:

a transfer belt comprising opposite ends fastened to the transfer base, and disposed to be movable along a disposition path of the plurality of guide rails;

a transfer motor configured to generate and provide an actuating force for movement of the transfer belt;

a transferer speed reducer connected to a motor shaft of the transfer motor for performing a speed-reducing function;

a transferer driving pulley disposed in an output terminal of the transferer speed reducer and engaging with a first side of the transfer belt; and a transferer driven pulley disposed spaced apart from the transferer driving pulley and engaging with a second side of the transfer belt.

3. The gait rehabilitation robot of claim 2, further comprising:

a main base in which the pair of actuator hanging members are disposed; and a cover disposed outside the pair of actuator hanging members.

4. The gait rehabilitation robot of claim 1, wherein the supporter rotation actuator comprises a supporter rotation motor, and a supporter speed reducer configured to reduce rotational speed of the supporter rotation motor, and the footrest supporter comprises a supporting link connected to an output terminal of the supporter speed reducer, and the horizontal base includes a rotation hole in which a connector of the supporting link is rotationally accommodated.

5. The gait rehabilitation robot of claim 4, further comprising:

a main base in which the pair of actuator hanging members are disposed; and a cover disposed outside the pair of actuator hanging members.

6. The gait rehabilitation robot of claim 1, further comprising:

a main base in which the pair of actuator hanging members are disposed; and a cover disposed outside the pair of actuator hanging members.

* * * * *